United States Patent [19]

Tunder

[11] 4,251,328

[45] Feb. 17, 1981

[54] GALLIUM PLATING

[75] Inventor: Richard S. Tunder, San Jose, Calif.

[73] Assignee: General Electric Company, Schenectady, N.Y.

[21] Appl. No.: 132,276

[22] Filed: Mar. 20, 1980

[51] Int. Cl.[3] ..... C25D 5/06; C25D 17/14; C25F 5/00

[52] U.S. Cl. ..... 204/15; 204/146; 204/224 R

[58] Field of Search ..... 204/15, 129.6, 146, 204/224 R, 45 R, 14 R

[56] References Cited

U.S. PATENT DOCUMENTS

| | | | |
|---|---|---|---|
| 828,814 | 8/1906 | Cunningham | 204/224 R |
| 2,108,700 | 2/1938 | Adey | 204/224 R |
| 2,931,758 | 4/1960 | Zimmerman | 204/14 R |
| 3,346,477 | 10/1967 | Wolfer | 204/224 R |

OTHER PUBLICATIONS

Modern Electroplating, Edited by Frederick A. Lowenheim, 3rd Edition, 1974, pp. 470, 481.

*Primary Examiner*—T. M. Tufariello

*Attorney, Agent, or Firm*—Lawrence D. Cutter; John F. Ahern

[57] ABSTRACT

A method and apparatus for the selective plating of liquid gallium metal on conductive surfaces is disclosed. The preferred embodiment of the present invention comprises a cylindrical tube of nonconductive material having an open end covered with felt material. The felt retains a reservoir of liquid gallium; floating on the liquid gallium is a reservoir of water containing a soluble metal hydroxide. Extending through the water solution and the liquid gallium is an electrode which is preferably positioned in the gallium but not against the felt cover. The resulting electroplating brush is employed in a vertical or near vertical position to brush plate gallium onto an electrically conductive surface which is maintained at a negative electrical potential with respect to the electrode. By reversing polarity of the surface with respect to the electrode, deplating of the surface may be performed.

18 Claims, 1 Drawing Figure

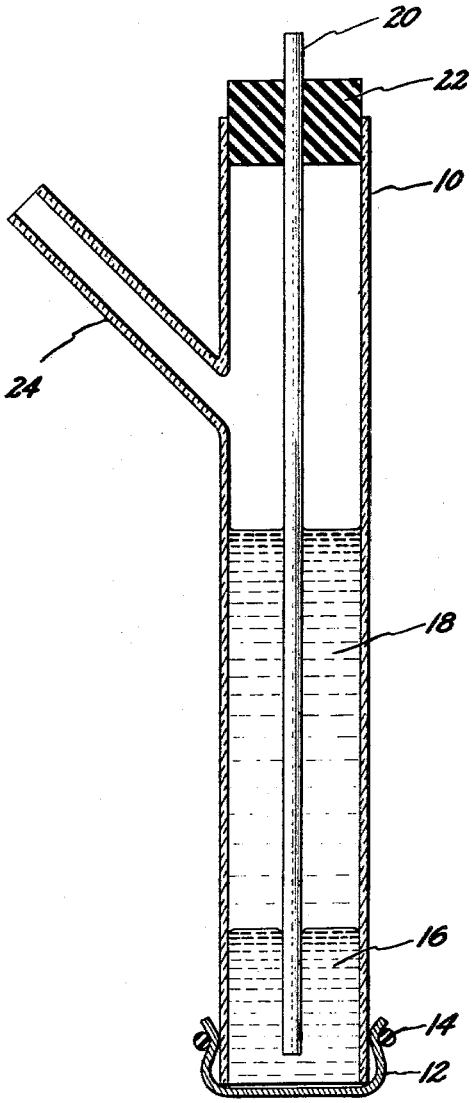
20
22
10
24
18
16
14
12

GALLIUM PLATING

BACKGROUND OF THE INVENTION

The present invention relates to an apparatus and a method for the plating and deplating of gallium onto electrically conductive surfaces. More particularly, the present invention relates to a brush plating apparatus for applying gallium to a metal surface.

It is important to distinguish at the outset the fact that the apparatus of the present invention performs an actual plating of gallium onto the desired conductive surface and not just a mere gallium deposition. While commercial solutions for gallium deposition appear to be available, deposition produces only physical contact while plating, on the other hand, results in chemical bonding.

Plating with gallium becomes particularly difficult in those situations in which it is desired to plate only portions of a large workpiece. Because immersion plating of gallium onto metal surfaces requires the use of a relatively strong caustic solution, conventional masking methods are generally unsatisfactory in their attempts to prevent local plating and to protect the surface of the metal from the caustic solution. Even if only partial immersion is attempted, caustic fumes which evolve during the plating process often produce deleterious effects upon the surface of the metal being plated. Furthermore, even in those situations in which successful local gallium plating of a large workpiece is performed, subsequent wear and abrasion may cause localized deplating to occur. In such cases, plating repairs are presently possible only through the methods originally employed to produce the plating, namely, immersion. As above, immersion of only those portions of the workpiece to receive new plating exposes the rest of the plated workpiece to caustic fumes which cause deplating elsewhere or deleteriously affects the surfaces which have not been plated, even stainless steel surfaces. These problems often occur in the situation in which it is desirable to plate only the circumference or edge portions of a large circular workpiece. Additionally, at present there is no satisfactory method to selectively deplate portions of the workpiece which have received excess or uneven plating.

SUMMARY OF THE INVENTION

In accordance with a preferred embodiment of the present invention a method of plating liquid gallium on an electrically conductive surface comprises applying a potential difference between said surface and an electrode penetrating a liquid gallium reservoir and then contacting the surface with one side of a swatch of gallium impermeable material, the other side of which is in contact with the liquid gallium reservoir. The electrode is disposed in the liquid gallium and also through an aqueous solution floating on the liquid gallium and containing a soluble metal hydroxide. Preferably, the electrode is not in contact with the swatch which may comprise felt or other gallium impermeable material. However, the swatch is permeable to the aqueous solution of metal hydroxide.

In accordance with another embodiment of the present invention an apparatus for the brush plating of gallium on an electrically conductive surface comprises an inert, nonconducting vessel with an opening at the bottom thereof closed off with a tip impermeable to gallium but permeable to an aqueous solution of metal hydroxide; the vessel holds a quantity of liquid gallium beneath a layer of an aqueous solution of a soluble metal hydroxide. The brush plating apparatus further includes an electrode disposed through said solution and into said liquid gallium but not in contact with the porous tip. Both the method and the apparatus of the present invention may be employed to apply a gallium plating onto selected portions of a relatively large workpiece. Furthermore, by reversing the polarity of the potential difference applied between the electrode and the workpiece, deplating may also be performed.

Accordingly, it is an object of the present invention to provide a method and an apparatus for the effective and selective plating and deplating of gallium on the surface of an electrically conductive workpiece.

DESCRIPTION OF THE FIGURE

The subject matter which is regarded as the invention is particularly pointed out and distinctly claimed in the concluding portion of the specification. The invention, however, both as to organization and method of practice, together with further objects and advantages thereof, may best be understood by reference to the following description taken in connection with the accompanying drawing in which:

The FIGURE is a partial cross-sectional view of a gallium plating brush in accordance with one embodiment of the present invention.

DETAILED DESCRIPTION OF THE INVENTION

The FIGURE illustrates an apparatus for practicing the plating method of the present invention. In particular, there is shown vessel 10 which may conveniently comprise an an elongate cylindrical tube having an inside diameter of approximately 0.5 inch. However, other convenient shapes and sizes for the vessel may also be employed, the specific size being determined by the needs of the user and the pressure against the tip 12. The electroplating brush shown is generally employed in a vertical or near vertical position. Deviation from a vertical operating position for the brush is limited by the necessity to keep liquid gallium between the tip and the electrolyte and by the necessity to keep the electrode in the gallium. The vessel 10 comprises an inert, electrically nonconductive material such as glass, polypropylene, polyolefin or polyethylene. In particular, the vessel material is selected to be inert with respect to the electrolyte 18.

The liquid electrolyte 18 disposed over and in contact with liquid gallium 16 preferably comprises an aqueous solution of sodium hydroxide. The concentration of sodium hydroxide is preferably between approximately 5 grams per 100 milliliters and 40 grams per 100 milliliters. The concentration of sodium hydroxide which is preferred is approximately 20 grams per 100 milliliters for positive plating of gallium onto a workpiece and approximately 10 grams per 100 milliliters for deplating gallium from the workpiece surface. As used herein and in the appended claims the term "selective plating" refers to the fact that the methods and apparatus of the present invention are employable to effect both positive plating and deplating and also to indicate the fact that the apparatus and methods of the present invention are employable to effect localized plating and deplating.

It has also been found that the addition of approximately 0.05 percent of catechol to the electrolyte 18 improves the effectiveness of positive plating onto the surface. Catechol is also known as orthodihydroxy benzene or 1,2 benzenediol, but is hereinafter referred to as catechol for brevity.

The vessel also preferably has a vent opening 24 above the surface of the electrolyte 18, to permit the escape of vapors evolved during plating or deplating processes. This vent opening may also be employed to add additional gallium to the brush so as to replace gallium which has been plated onto the workpiece. The gallium can be easily added in desired quantities through this opening, and it will, because of its density, come to rest at the bottom of the vessel between the porous tip 12 and the electrolyte 18.

The tip 12 must comprise a specially selected material which is permeable to the flow of electrolyte 18 but not liquid gallium. The tip 12 typically comprises a swatch of porous, gallium impermeable material affixed around and closing off the opening in vessel 10. For example, as shown in the FIGURE, the tip 12 is fixed to the tube by means of flexible O-ring 14. Spongy materials in which the microscopic structure comprises a large number of cul-de-sacs have been found to be unsuitable for the purposes of the present invention because of the inability of the material to provide pathways for the passage of electrolyte. However, several materials are appropriate for use as a tip. These include for example, a layer of loose felt held onto the vessel by a fiberglass screen. Additionally, polypropylene mesh is also employable as a tip material. However, felt is a preferred material for the porous tip. The felt may be comprised of such materials as glass wool, polyester, polypropylene, or nylon. Preferably the tip comprises felt having a thickness of approximately 1/16 inch and an area density of approximately 12 ounces per square yard. Such material has been found to produce effective and uniform plating. Of the many tip materials which have been tested for their effectiveness in gallium plating the above-described felt material has proven to be the most effective. Other tip materials which would appear to be employable have been found either to produce no plating or plating which is not as effective as felt. For example, porous linear polyethylene slices over the end of a plastic tube have also been employed as brush tips but even at plating voltages as high as 30 volts this material produces a less effective plating than obtained with felt.

If positive plating (i.e., onto the surface) is desired, then the liquid electrolyte 18 preferably comprises a solution of approximately 20 grams per 100 milliliters of sodium hydroxide, with up to 0.05 gram per 100 milliliters of catechol. However, for deplating operations, the preferable electrolyte comprises approximately 10 grams per 100 milliliters of sodium hydroxide with up to 1 gram per 100 milliliters of catechol. While sodium hydroxide is the preferred solute for the electrolyte, any soluble metal hydroxide is also employable. Sodium hydroxide is presently preferred chiefly because of its effectiveness and low cost. The electrolyte functions as a source of hydroxy ions in solution. The applied potential difference and resulting current flow facilitate the use of the solution as a carrier medium for temporarily dissolving the gallium prior to its plating onto the workpiece. Accordingly, other electrolytes having these characteristics may also be employed.

The electrode 20 in the FIGURE preferably comprises tungsten. The electrode itself is disposed through the electrolyte solution 18 and into the liquid gallium 16. The tip of the electrode is positioned as close as possible to the tip 12, but not contacting it directly, and, of course, not penetrating it. The electrode 20 may be supported by any convenient electrically insulating structure, such as by rubber stopper 22, as shown.

While the drawing shows the electrode 20 disposed through the electrolyte 18 and into the gallium 16, this is for convenience only. The brush works just as well with the electrode 20 entering the vessel 10 from the side and only contacting the gallium 16. However, such a side mounted electrode is inconvenient.

It is nonetheless essential to the operation of the brush that there be seepage or creepage of electrolyte around the gallium when the current is flowing. While this may occur along a centrally disposed electrode as shown, it is not essential for effective operation.

Because the melting point of gallium is approximately 30° C., many work environments may require means to maintain the gallium in a liquid state. For this purpose infrared lamps may be directed at the brush to maintain the gallium in a liquid state.

After the electroplating brush is assembled and filled with gallium and electrolyte, to start plating the tip is wetted with electrolyte such as from a squeeze bottle. Power supply contacts are applied to the electrode and to the workpiece. To effect positive plating of the gallium onto the workpiece, the workpiece is connected to the negative (cathodic) side of a direct current power supply and the electrode is connected to the positive (anodic) power supply terminal. The power supply is set at a voltage of approximately 6 volts and the brush tip is brought into light contact with the metal surface to be plated and the tip is moved in accordance with those areas which are to be plated and how fast the plating is to occur. When contact between the brush and the metal surface is made and plating begins, a slow feed of electrolyte from inside the brush occurs through the gallium by means of a creepage effect caused by the electrical field. The electrolyte creepage occurs along the vessel walls and along the electrode rod. The liquid gallium in the brush may be said to "rotate" and carry some electrolyte with it, which is absorbed when it touches the felt. The gallium anode oxidizes to give soluble gallium which the electrolyte carries to the cathode workpiece to which it is plated. When plating is completed, the workpiece surface is preferably rinsed briefly with acetone and dried. With the preferred electroplating brush of the present invention, plating currents of 4 to 5 amperes at a voltage of 6 volts occur. For deplating, the voltage polarity is reversed, and at a voltage of 6 volts, deplating is readily accomplished. This is particularly effective for the correction of plating errors. In deplating, the workpiece surface is not attacked and the only effect is one of deplating; the original surface is recovered.

The electroplating brush of the present invention plates out gallium evenly in seconds, remains relatively cool (particularly at plating currents below 2 amperes) and does not generate objectionable quantities of fuming caustic electrolyte. The porous tips of the present invention wear well, are easy to replace and reuse. After plating, the gallium and electrolyte are removed; the vessel and tip are rinsed in water, air-dried and stored, ready for the next use. The felt tips may retain a gray color from entrapped gallium but this has no effect on their reusability.

From the above it may be appreciated that the present invention provides an apparatus and a method for the effective and easy plating of gallium onto conductive workpieces. The apparatus is both simple and inexpensive to construct and provides for the plating of gallium onto a conductive workpiece in essentially the same manner as ordinary paint is applied to a wall. However, unlike paint, the application of gallium produces significantly stronger chemical bonding than is found in the mere deposition of paint-like coatings. Moreover, the present invention is particularly advantageous in that it readily provides the ability to perform corrective deplating through an easily implemented polarity reversal. This selective plating is particularly effective on steel surfaces and presents no problem of chemical attack against the metal to be plated.

While the invention has been described in detail herein in accord with certain preferred embodiments thereof, many modifications and changes therein may be effected by those skilled in the art. Accordingly, it is intended by the appended claims to cover all such modifications and changes as fall within the true spirit and scope of the invention.

The invention claimed is:

1. A plating and deplating brush for application of gallium on an electrically conductive workpiece, comprising:

an inert, nonconductive vessel with an opening of selected diameter at the bottom thereof;

a porous, gallium impermeable tip closing off said opening;

a quantity of liquid gallium disposed within said vessel in contact with said tip;

a liquid electrolyte acting as a source of hydroxy ions and as a carrier for gallium, said electrolyte floating on said liquid gallium; and an electrode extending into said gallium whereby a potential difference may be applied between said brush and said workpiece to effect selective plating and deplating of the workpiece surface with gallium.

2. The brush of claim 1 in which said electrolyte is an aqueous solution of soluble metal hydroxide.

3. The brush of claim 1 in which said tip comprises material selected from the group consisting of felt and polypropylene mesh.

4. The brush of claim 1 in which said tip comprises felt of material selected from the group consisting of glass wool, polyester, polypropylene, and nylon.

5. The brush of claim 1 in which said porous tip comprises felt having a thickness of approximately 1/16 inch and an area density of approximately 12 ounces per square yard.

6. The brush of claim 1 in which said electrolyte comprises a mixture of water with sodium hydroxide at a concentration between approximately 5 grams per 100 milliliters and 40 grams per 100 milliliters.

7. The brush of claim 6 in which said electrolyte further includes a finite amount of catechol at a concentration below approximately 1 gram per 100 milliliters.

8. The brush of claim 6 in which said sodium hydroxide concentration is approximately 20 grams per 100 milliliters.

9. The brush of claim 1 in which said electrode is not in contact with said porous tip.

10. The brush of claim 1 in which said vessel comprises material selected from the group consisting of glass, polypropylene, polyethylene, and polyolefin.

11. The brush of claim 1 in which said vessel is cylindrical and said electrode is centrally disposed along the axis of said cylinder.

12. The brush of claim 1 in which said vessel has a vent opening above the surface of said solution.

13. The brush of claim 1 in which said electrode comprises tungsten.

14. The brush of claim 1 further including heating means to maintain said gallium in a liquid state.

15. A method of selectively plating gallium on the surface of an electrically conductive workpiece comprising:

disposing gallium in an inert, nonconductive vessel below an aqueous solution containing a soluble metal hydroxide, said vessel having an opening covered by a porous, gallium impermeable sheet of selected material and also having an electrode extending into said gallium in close proximity to said porous sheet;

applying a potential difference between said electrode and said workpiece;

moving said porous sheet in contact with said workpiece.

16. The method of claim 15 in which said potential difference places said workpiece at a negative electric potential with respect to said electrode, whereby gallium is plated onto said workpiece.

17. The method of claim 15 in which said potential difference places said workpiece at a positive electric potential with respect to said electrode, whereby gallium may be removed from said workpiece.

18. A method of plating liquid gallium on a conductive surface comprising:

applying a potential difference between said surface and an electrode penetrating said liquid gallium;

contacting said surface with one side of a layer of porous gallium impermeable material, the other side of which is in contact with said liquid gallium, said electrode being in close proximity to said layer and said liquid gallium being in contact with an aqueous solution of a soluble metal hydroxide, which is also in contact with said electrode.

* * * * *